United States Patent [19]

Komura et al.

[11] 4,075,919

[45] Feb. 28, 1978

[54] CUTTING BLADE OF A DEVICE FOR CUTTING A YARN IN A TEXTILE MACHINE

[75] Inventors: Ikuo Komura, Toyota; Hideo Tamai, Kariya; Takayuki Morita, Obu, all of Japan

[73] Assignee: Kabushiki Kaisha Toyoda Jidoshokki Seisakusho, Japan

[21] Appl. No.: 536,751

[22] Filed: Dec. 27, 1974

[30] Foreign Application Priority Data

Dec. 27, 1973 Japan ..... 49-370

[51] Int. Cl.[2] ..... B26D 1/14

[52] U.S. Cl. ..... 83/676; 76/24 C

[58] Field of Search ..... 83/676; 76/246

[56] References Cited

U.S. PATENT DOCUMENTS

| | | | |
|---|---|---|---|
| 852,873 | 5/1907 | Davidson | 76/24C |
| 3,513,514 | 5/1970 | Furiness et al. | 83/676 |

*Primary Examiner*—Donald R. Schran

[57] ABSTRACT

A cutting blade of a device for cutting a yarn in a textile machine such as a spinning frame, rewinding machine, weaving machine. The cutting blade is provided with a main body and a sharp cutting edge formed on a periphery portion thereof by an etching process.

6 Claims, 8 Drawing Figures

CUTTING BLADE OF A DEVICE FOR CUTTING A YARN IN A TEXTILE MACHINE

SUMMARY OF THE INVENTION

The present invention relates to a cutting blade of a device for cutting a yarn in a textile machine.

It is a recent tendency to utilize a non manual cutting device for the cutting of yarns during mill operations, for example, the cutting of a tail end yarn from a yarn package at the time of carrying out the doffing operation, the cutting of a processing yarn when a yarn defect is detected during the winding operation and the cutting of a filing yarn during the weaving operation, etc. Since the cutting device is usually mounted on the textile machine in a very small space, it is necessary to provide a compact cutting device and, consequently, a very small plate is utilized for making the cutter blade of the above-mentioned cutting device.

In the conventional method for producing the cutting blade for the cutting device, a material is made from a thin steel plate by pressing, and the cutting edge thereof is made by grinding the peripheral edge portion thereof, or the burr formed by the pressing operation is utilized as the cutting edge of the blade without any finishing. However, the first mentioned cutting edge is very delicate to make and, consequently, the grinding operation must be carried out carefully. On the other hand, the second mentioned cutting edge does not have a uniform edge and lacks sharp cutting ability. As a result, manufacture of the first mentioned cutting blade is not suitable to mass production, while the second mentioned cutting blade lacks the desired utility.

The principle object of the present invention is to provide a cutting blade of a device for cutting a yarn in a textile machine, which eliminates the above-mentioned drawbacks of the conventional cutting blade.

The cutting blade of the present invention is produced by applying a so-called etching method such as the photoetching method. The cutting blade comprises a main thin body and a sharp cutting edge formed at a peripheral edge portion thereof by an etching process. This cutting blade can be very usefully utilized for a cutting device mounted on each spindle of a textile machine.

DETAILED EXPLANATION OF THE INVENTION

For the sake of a better understanding of the advantage of the cutting blade according to the present invention, the drawbacks of the conventional cutting blade are firstly explained.

Figure 1:
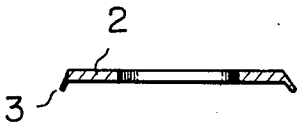
FIGS. 1 and 2 are side views of a cutting blade made by conventional methods.

In a conventional method of producing a cutting blade, a thin steel plate is pressed so as to produce a cutting blade 2. The cutting blade 2 thus produced is provided with a sharp burr 1 which is capable of being utilized as a cutting edge 3 as shown in FIG. 1. However, this cutting edge 3 is not uniform and is not strong enough to use over a long period of time.

Figure 2:
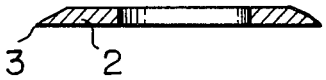

In another conventional method for producing the cutting blade 2, the above-mentioned cutting blade 2 is utilized as a material, and the peripheral edge thereof is finished by grinding so as to form a sharp cutting edge 3, as shown in FIG. 2. However, sharpening of the cutting edge 3 of the cutting blade 2 requires a very delicate grinding operation. Consequently, this method for manufacturing the cutting blade is not suitable to mass production.

Figure 3:
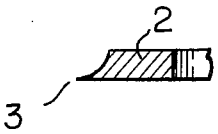
FIGS. 3 and 4 are side views of a part of cutting blades according to the present invention.
Figure 4:
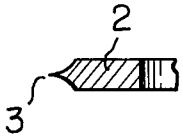
Figure 5:
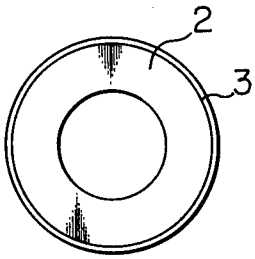
FIGS. 5, 6 and 7 are plan views of the cutting blades according to the present invention.

According to our continuous study concerning cutting blades, we have found that an etching method can be successfully applied for producing cutting blades for use in the cutting device of textile machinery. The so called photoetching technology is preferably applied to produce the cutting blade according to the present invention. That is, a pattern of the cutting blades is firstly produced on a polyester film in a suitable size, a picture of the above-mentioned pattern is taken with a camera containing negative film and, then, the film is developed so as to produce a negative pattern film. Thereafter, a master pattern is produced on a positive film by the so called reverse printing method. This master pattern is a black and white picture. A thin steel plate or stainless steel plate is covered with a photosensitive resin and a film or layer of this photosensitive resin is fixed on the above-mentioned thin plate by heat setting. Next, the above-mentioned master pattern is fixed on the layer of photosensitive resin heat set on the thin plate and an ultraviolet ray is projected on the master pattern. As a result of the above-mentioned projection of the ultraviolet ray, a predetermined potential pattern, which corresponds to the master pattern, is formed on the layer of the photosensitive resin. Then, the above-mentioned treated thin plate is developed by the dipping method so that all of the photosensitive resin except that forming the above-mentioned master pattern is eliminated from the thin plate. The thusly prepared thin plate is treated by an etching liquid, such as a strong acid liquid, so that the portions of the thin plate where the photosensitive resin has been removed is etched Therefore, if it is desired to produce a thin circular cutting blade 2, which is provided with a circular cutting edge 3 formed at the peripheral edge thereof as shown in FIGS. 3 and 5, the pattern of the cutting blade should coincide with the pattern shown in FIGS. 3 and 5. In this embodiment, the very sharp circular edge 3 is formed at the circular edge portion of the cutting blade 2. If, it is required to produce a cutting blade 2 provided with a cutting edge 3 as shown in FIG. 4, first, a photosensitive resin layer is heat-set on each of the two surfaces of the thin plate, then, using a pair of master patterns, a master pattern is fixed on each of the two photosensitive resin layers so that the two patterns coincide and, finally an ultraviolet ray is projected from both sides of the thin plate.

The sharpness of the cutting edge of the cutting blade can be preferably changed by changing the concentration or quantity of the etching liquid.

Figure 6:
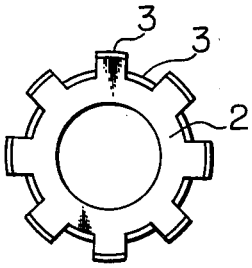
Figure 7:
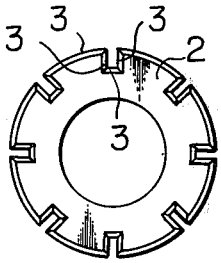

The embodiments shown in FIGS. 6 and 7 are modifications of the cutting blade shown in FIG. 5. In the embodiment shown in FIG. 6, the cutting blade 2 is provided with a plurality of radially projected portions 3*a* symmetrically arranged along the periphery portion thereof, while in the embodiment shown in FIG. 7, the cutting blade 2 is provided with a plurality of cut-out grooves 3*b* symmetrically arranged along the periphery portion thereof.

Figure 8:
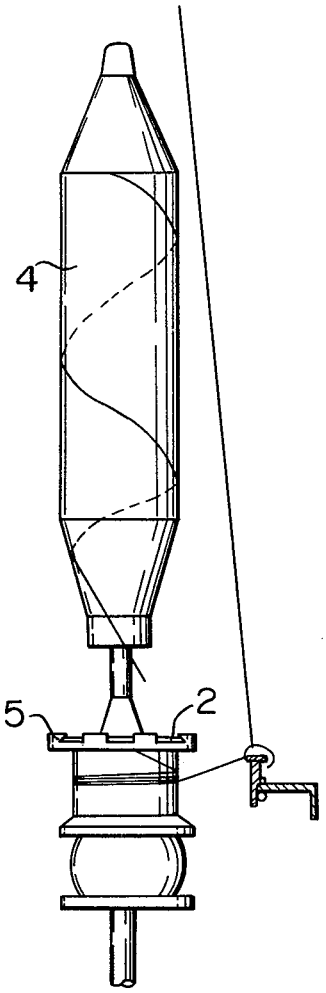
FIG. 8 is a schematic side view of a spindle whereon a cutting device utilizing a cutting blade according to the present invention is mounted.

FIG. 8 shows a side view of the cutting device utilized for a textile machine, wherein the cutting blade 3 shown in FIG. 5 is mounted. This cutting device is described in detail in the specification of the copending patent application Ser. No. 536,570 filed on Dec. 27, 1974 now U.S. Pat. No. 3,967,440. This cutting device comprises a round guide member 5 mounted on a base portion of a spindle 10, a cylindrical crip member 6 coaxially secured to the spindle 10 at a position right below the guide member 5 and a thin round cutting blade 2, which is shown in FIG. 5, coaxially mounted on the guide member 5. The cutting blade 2 is provided with a circular knife edge 3 as shown in FIG. 3. The diameter of the crip member 6 is smaller than the diameter of the guide member 5. The guide member 5 is provided with a round recess which is capable of receiving the cutting blade 2 therein. To hold the cutting blade 2 in the round recess in a stable condition, an inside wall of the recess is inclined inward from the bottom of the recess to the top edge of the recess.

In this cutting device, a plurality of cut-out grooves 7 are formed at the circumferential wall of the guide member 5 so as to project the knife edge 3 of the cutting blade 2 from the cut-out grooves 7.

When a full size yarn package 4 is formed on each spindle 10 of a textile machine such as a ring spinning frame or ring twisting frame, firstly, a ring rail 8 is displaced to its lowermost position while each spindle 10 is rotating by its inertia. According to the above-mentioned displacement of the ring rail 8, a spiral winding of yarn is formed on the yarn package 4 and the tail-end winding 9 is formed on the crip member 6 of the cutting device so that a straight yarn portion 11 is formed along a passage between the bottom end of the spiral winding of yarn on the yarn package 4 and the tail-end winding 9 in such a way that the straight yarn portion 11 passes through one of the above-mentioned cut-out grooves 7. When the straight portion 11 of the tail-end yarn is introduced into the cut-out groove 7, the straight portion 11 is urged to the knife edge of the cutting blade 2 in an inclined condition to the cutting edge. Further, since the outside diameter of the cylindrical portion of the crip member 6 is smaller than the yarn guide member 5, the above-mentioned yarn portion 11 of the tail-end yarn between the yarn package 4 and crip member 6 is maintained in a straight condition and the yarn is forced to the knife edge of the cutting blade 2.

When the full size yarn package 4 is taken from the respective spindles 10, since the yarn package 4 is displaced upward, the yarn portion 11, which extends between the spiral winding of the yarn package 4 and the tail-end yarn winding 9 wound on the crip portion 6, is laterally displaced toward the *x* direction shown in FIG. 8. During the above-mentioned lateral displacement of the straight yarn portion 11, since a yarn portion adjacent to the tail-end winding 9 engages the bottom edge of the cut-out groove 7, the yarn portion 11 is turned around the bottom edge and, consequently, the yarn portion 11 is displaced toward the *x* direction while being urged against the knife edge 3 of the cutting blade 2. In this condition, the yarn portion 11 is bent. Accordingly, a very effective shearing force is applied to the yarn portion 11 so that the cutting of the straight yarn portion 11 by the cutting edge 3 of the cutting blade 2 can be carried out perfectly. As mentioned above, the cutting blade according to the present invention is very suitable for adoption to the cutting device utilized for a textile machine.

We claim:

1. In a device for cutting a tail-end yarn portion, a cutting blade comprising:

a main body formed from thin plate and having at least one sharp cutting edge formed on at least one peripheral portion of said main body, said sharp cutting edge being provided with at least one etched surface formed on one side thereof.

2. In a device for cutting a tail-end yarn portion as in claim 1, wherein said sharp cutting edge is formed on a circular peripheral edge portion of said main body.

3. In a device for cutting a tail-end yarn portion as in claim 1, wherein said one etched surface is annular about said body and configured arcutely inward toward said body and extending between an outer surface of said body and said cutting edge.

4. In a device for cutting a tail-end yarn portion as in claim 1, wherein said sharp cutting edge is provided with two etched surfaces formed on each side of said sharp cutting edge, said surfaces being annular about said body and configured arcutely inward toward said body and extending in diverging relationship between said cutting edge and said outer surfaces of said body.

5. In a device for cutting a tail-end yarn portion as in claim 1, wherein a plurality of sharp cutting edges are formed on a plurality of radially projected portions symmetrically arranged at a circular peripheral edge portion of said main body.

6. In a device for cutting a tail-end yarn portion as in claim 1, wherein said sharp cutting edge is formed along a plurality of radially arranged slits formed on a circular peripheral edge portion of said main body.

* * * * *